US010543951B2

(12) United States Patent
Costanzo, Jr.

(10) Patent No.: US 10,543,951 B2
(45) Date of Patent: Jan. 28, 2020

(54) ONE-PIECE, FOLDABLE COOLER

(71) Applicant: ThatBox Design, LLC, Fort Mill, SC (US)

(72) Inventor: Donn J. Costanzo, Jr., Fort Mill, SC (US)

(73) Assignee: THATBOX DESIGN, LLC, Fort Mill, SC (US)

( * ) Notice: Subject to any disclaimer, the term of this patent is extended or adjusted under 35 U.S.C. 154(b) by 0 days.

(21) Appl. No.: 16/059,348

(22) Filed: Aug. 9, 2018

(65) Prior Publication Data

US 2019/0047743 A1 Feb. 14, 2019

Related U.S. Application Data

(60) Provisional application No. 62/543,365, filed on Aug. 9, 2017.

(51) Int. Cl.

| | |
|---|---|
| ***B65D 5/468*** | (2006.01) |
| ***B65D 5/36*** | (2006.01) |
| ***B65D 5/42*** | (2006.01) |
| ***B31B 50/26*** | (2017.01) |
| ***B31B 50/73*** | (2017.01) |
| *B31B 120/30* | (2017.01) |
| *B31B 100/00* | (2017.01) |

(Continued)

(52) U.S. Cl.

CPC ..... *B65D 5/4608* (2013.01); *B31B 50/26* (2017.08); *B31B 50/734* (2017.08); *B65D 5/3628* (2013.01); *B31B 2100/00* (2017.08); *B31B 2110/35* (2017.08); *B31B 2120/10* (2017.08); *B31B 2120/302* (2017.08); *B65D 5/4266* (2013.01)

(58) Field of Classification Search

CPC .. B65D 5/241; B65D 5/4608; B65D 5/46112; B65D 5/563; B65D 5/3678; B65D 81/38; B31B 1/76; B31B 1/26; F25D 3/08; F25D 3/06

USPC ..... 229/117.14, 186, 117.06, 138, 920, 114, 229/117.01, 190; 206/163, 169, 427; 493/311; 62/457.5, 371, 457.1, 457.7, 62/464

See application file for complete search history.

(56) References Cited

U.S. PATENT DOCUMENTS 2,007,810 A * 7/1935 Oman ..... B65D 5/46112 229/117.15

2,008,443 A * 7/1935 Froehlig ..... B65D 5/241 206/169

(Continued)

*Primary Examiner* — Christopher R Demeree

(74) *Attorney, Agent, or Firm* — Chad D Tillman; Jeremy C Doerre; Tillman Wright, PLLC

(57) ABSTRACT

A cooler includes panels defining a storage area; corner panels; top panels forming a lid; a first handle panel connected to a first top panel and having a slot formed therein; a second handle panel connected to a second top panel and having a slot formed therein; and a first tab panel connected to a corner panel and having a tab defining a recess, the tab being configured to extend through the slot of the first handle panel and through the slot of the second handle panel for locking the handle panels and top panels in a fully closed, carry configuration of the cooler. Portions of the first and second handle panels are received within the recess defined by the tab. The second handle panel can be unlocked and the storage area accessed while holding the cooler with the first handle panel.

10 Claims, 4 Drawing Sheets

(51) Int. Cl.
*B31B 110/35* (2017.01)
*B31B 120/10* (2017.01)

(56) References Cited

U.S. PATENT DOCUMENTS 4,238,069 A * 12/1980 Morris, Jr. ..... B65D 5/2047 229/114
5,020,337 A * 6/1991 Krieg ..... F25D 3/06 229/103
5,042,715 A * 8/1991 McNeill ..... B65D 5/26 229/117.15
5,062,527 A * 11/1991 Westerman ..... B65D 5/3678 229/117
5,582,343 A * 12/1996 Dalvey ..... B65D 5/0005 229/101
5,853,121 A * 12/1998 Francisco ..... B65D 5/2047 229/188
6,182,465 B1 * 2/2001 Ricci ..... B65D 5/244 62/371
6,253,993 B1 * 7/2001 Lloyd ..... B65D 5/2047 229/112
7,487,904 B2 * 2/2009 McClure ..... B65D 5/3678 229/117.05
7,611,042 B2 * 11/2009 Bates ..... B65D 5/0005 206/427
7,717,318 B2 * 5/2010 Brand ..... B65D 5/0005 229/101
7,721,941 B2 * 5/2010 Kleiner ..... B65D 5/3678 229/117.05
7,841,512 B2 * 11/2010 Westerman ..... B65D 5/6697 229/117.01
D710,691 S * 8/2014 Genender ..... D9/433
D710,692 S * 8/2014 Genender ..... D9/433
D714,139 S * 9/2014 Genender ..... D9/433
D720,989 S * 1/2015 Genender ..... D9/433
9,499,294 B1 * 11/2016 Costanzo, Jr. ..... B65D 5/241

* cited by examiner

ONE-PIECE, FOLDABLE COOLER

CROSS-REFERENCE TO RELATED APPLICATION

The present application is a U.S. nonprovisional patent application of, and claims priority under 35 U.S.C. § 119(e) to, U.S. provisional patent application 62/543,365, filed Aug. 9, 2017, which provisional patent application is incorporated by reference herein. A portion of the disclosure of the '365 application is contained in the Appendix, which is incorporated herein by reference.

COPYRIGHT STATEMENT

Any new and original work of authorship in this document—including any source code—is subject to copyright protection under the copyright laws of the United States and other countries. Reproduction by anyone of this document as it appears in official governmental records is permitted, but otherwise all other copyright rights whatsoever are reserved.

COMPUTER PROGRAM LISTING

Submitted concurrently herewith via the USPTO's electronic filing system, and incorporated herein by reference, are one or more computer program files including instructions, routines, and/or other contents of several computer programs. A table setting forth the name and size of files included in the computer program listing is included below.

| File Name | Creation Date | File Size (bytes) |
|---|---|---|
| ascify.txt | 08/08/2018 09:33 | 37473 |
| readme.txt | 08/08/2018 09:33 | 2581 |
| code.txt | 08/08/2018 09:33 | 6446192 |

One of these files, "readme.txt", contains instructions for extracting information from other of the files. This other file represents a compressed binary file that has been converted to ascii format. This file can be converted back to a compressed .zip archive utilizing an assembly conversion program, the source code for which is contained in "ascify.txt". The readme file includes instructions for compiling and running this conversion program, and instructions for converting the other text file to a compressed, binary file. This compressed, binary file includes an .mp4 video illustrating aspects and features in accordance with one or more preferred embodiments.

BACKGROUND OF THE INVENTION

The present invention generally relates to coolers and, in particular, inexpensive disposable coolers preferably made of corrugated cardboard used for containing ice together with beverages, food, or both beverages and food.

Inexpensive disposable coolers for containing ice together with beverages, food, or both beverages and food are known. Such an exemplary cooler is made from a single sheet of material such as corrugated cardboard, and is disclosed for example in U.S. Patent Application Publication 2012/0234715, which is incorporated herein by reference in its entirety. The present invention is believed to represent an improvement over such exemplary coolers, particularly with respect to the ability to access the interior of the cooler without having to completely unlock a top panel of the cooler, which top panel can remain in covering relation to a top of the cooler. Thus, one can access a beverage, for example, while holding the cooler above the ground with a single hand.

SUMMARY OF THE INVENTION

The present invention includes many aspects and features. Moreover, while many aspects and features relate to, and are described in, the context of corrugated cardboard, the present invention is not limited to use only in such context and may be used with other materials as will become apparent to an Ordinary Artisan from the following summaries and detailed descriptions of aspects, features, and one or more embodiments of the present invention.

Accordingly, in a first aspect of the invention, a one-piece, foldable cooler, comprises: (a) a storage portion, including: (i) a bottom panel comprising first and second bottom subpanels (10,11), (ii) two side panels (12,14), (iii) a first end panel comprising first and second end subpanels (16, 17), and (iv) a second end panel comprising first and second end subpanels (18,19); (b) four corner panels comprising, (i) a first corner panel comprising first and second corner panels (20,21), (ii) a second corner panel comprising first and second corner panels (22,23), (iii) a third corner panel comprising first and second corner panels (24,25), and (iv) a fourth corner panel comprising first and second corner panels (26,27); (c) two top panels for forming a cooler lid comprising, (i) a first top panel (28), and (ii) a second top panel (30); (d) a first handle panel comprising, (i) a first handle subpanel (32) having first and second slots (31,33) formed therein, and (ii) a second handle subpanel (34) having first and second slots (35,37) formed therein, with a fold line extending between and dividing the first and second handle subpanels along which the first and second handle subpanels when folded form a two-ply handle of the cooler; (e) a second handle panel (36) having first and second slots (39,41) formed therein; (f) a first tab panel comprising, (i) a first tab subpanel (42), and (ii) a second tab subpanel (44), with a fold line extending between and dividing the first and second tab subpanels along which the first and second tab subpanels when folded form a first two-ply tab from "L" shaped protuberances (43,45), (iii) wherein the first tab panel is integral with the first corner panel and the first top panel, with a fold line extending between and dividing the first tab panel and the first corner panel, and with a fold line extending between and dividing the first tab panel and the first top panel, (iv) wherein the first two-ply tab is configured to extend through slots (31,35) of the first handle panel for locking the first handle panel and first top panel in a partially closed, carry configuration of the cooler, and (v) wherein the first two-ply tab is configured to extend further through slot (39) of the second handle panel for locking the second handle panel and second top panel in a fully closed, carry configuration of the cooler; and (g) a second tab panel comprising, (i) a first tab subpanel (46), and (ii) a second tab subpanel (48), with a fold line extending between and dividing the first and second tab subpanels along which the first and second tab subpanels when folded form a second two-ply tab from "L" shaped protuberances (47,49), (iii) wherein the second tab panel is integral with the second corner panel and the first top panel, with a fold line extending between and dividing the second tab panel and the second corner panel, and with a fold line extending between and dividing the second tab panel and the first top panel, (iv) wherein the second two-ply tab is configured to extend through slots (33,37) of the first handle panel for locking the first handle panel and first top panel in the partially closed, carry configuration of the cooler, and (v) wherein the second two-ply tab is configured to extend further through slot (41) of the second handle panel for locking the second handle panel and second top panel in the fully closed, carry configuration of the cooler, with an interior of the cooler being accessible by transitioning the second handle panel and second top panel to an open position while the first handle panel and the first top panel are in the partially closed, carry configuration of the cooler.

In a feature, each tab is locked with the first handle panel by manipulating a portion of the first handle panel within a recess defined by and between each respective tab and the tab subpanels thereof. The second handle panel preferably is locked onto the tabs by receiving a portion of the second handle panel within the recess defined by and between each respective tab and the tab subpanels thereof.

In a feature, each of the slots (31,33,35,37) is configured for a tab to be inserted and withdrawn therethrough adjacent a proximal side portion of the slot, and is configured for a tab not to be inserted and withdrawn therethrough adjacent a distal side portion of the slot, whereby outward positioning of a tab when inserted through a slot locks the tab within the slot against being withdrawn from the slot. Preferably, the slots (39,41) formed in the second handle panel overlap a portion of the slots formed in the first handle panel that includes the distal side portions thereof but that does not include the proximal side portions thereof, whereby the second handle panel locks the tabs in their outward disposition and keeps the tabs from being moved to adjacent the proximal side portions of the slots formed in the first handle portion when the second handle panel is locked.

In a feature, the panels of the one-piece, foldable cooler are formed from a single, integral piece of corrugated cardboard, and wherein the cooler is made by folding a single sheet of corrugated cardboard.

In a feature, the cooler further comprises a grip formed by a cutout in the second handle subpanel (34) so as to define a hinged flap (50); a corresponding opening (52) formed in the first handle subpanel (32); and another corresponding opening (54) formed in the handle panel (54), with the flap (50) being extendable through openings (52,54) when the cooler is in the fully closed, carry configuration.

In a feature, fold lines comprise score lines.

In a feature, fold lines comprise lines of weakness in the corrugated material of the cooler.

In a feature, the cooler is transitioned to an assembled configuration for use from a flat configuration by folding a single sheet of corrugated material along the fold lines. Preferably, the first corner panel is adhered or otherwise affixed to the first end panel, the second corner panel is adhered or otherwise affixed to the second end panel, and the third and fourth corner panels are adhered or otherwise affixed to the second side panel from which the second top panel extends when the cooler is in the assembled configuration; and a fold line bisects the end panels and bottom panel such that the cooler when in the assembled configuration is foldable into a collapsed configuration for storage, shipping, disposal or recycling after use, and/or retail sale.

In a feature, the cooler is a flat configuration.

In a feature, the cooler is an unassembled configuration in the form of a blank.

In a feature, the cooler is an assembled configuration.

In a feature, the cooler comprises a fold line that bisects the cooler and the cooler is in a flat configuration, folded along said bisecting fold line.

In another aspect, a one-piece blank for making a foldable corrugated cooler comprises a plurality of fold lines defining panels therein comprising: (a) a storage portion, including: (i) a bottom panel comprising first and second bottom subpanels (10,11), (ii) two side panels (12,14), (iii) a first end panel comprising first and second end subpanels (16, 17), and (iv) a second end panel comprising first and second end subpanels (18,19); (b) four corner panels comprising, (i) a first corner panel comprising first and second corner panels (20,21), (ii) a second corner panel comprising first and second corner panels (22,23), (iii) a third corner panel comprising first and second corner panels (24,25), and (iv) a fourth corner panel comprising first and second corner panels (26,27); (c) two top panels for forming a cooler lid comprising, (i) a first top panel (28), and (ii) a second top panel (30); (d) a first handle panel comprising, (i) a first handle subpanel (32) having first and second slots (31,33) formed therein, and (ii) a second handle subpanel (34) having first and second slots (35,37) formed therein, with a fold line extending between and dividing the first and second handle subpanels along which the first and second handle subpanels when folded form a two-ply handle of the cooler; (e) a second handle panel (36) having first and second slots (39,41) formed therein; (f) a first tab panel comprising, (i) a first tab subpanel (42), and (ii) a second tab subpanel (44), with a fold line extending between and dividing the first and second tab subpanels along which the first and second tab subpanels when folded form a first two-ply tab from "L" shaped protuberances (43,45), (iii) wherein the first tab panel is integral with the first corner panel and the first top panel, with a fold line extending between and dividing the first tab panel and the first corner panel, and with a fold line extending between and dividing the first tab panel and the first top panel, (iv) wherein the first two-ply tab is configured to extend through slots 31,35 of the first handle panel for locking the first handle panel and first top panel in a partially closed, carry configuration of the cooler, and (v) wherein the first two-ply tab is configured to extend further through slot 39 of the second handle panel for locking the second handle panel and second top panel in a fully closed, carry configuration of the cooler; and (g) a second tab panel comprising, (i) a first tab subpanel (46), and (ii) a second tab subpanel (48), with a fold line extending between and dividing the first and second tab subpanels along which the first and second tab subpanels when folded form a second two-ply tab from "L" shaped protuberances (47,49), (iii) wherein the second tab panel is integral with the second corner panel and the first top panel, with a fold line extending between and dividing the second tab panel and the second corner panel, and with a fold line extending between and dividing the second tab panel and the first top panel, (iv) wherein the second two-ply tab is configured to extend through slots 33,37 of the first handle panel for locking the first handle panel and first top panel in the partially closed, carry configuration of the cooler, and (v) wherein the second two-ply tab is configured to extend further through slot 41 of the second handle panel for locking the second handle panel and second top panel in the fully closed, carry configuration of the cooler, with an interior of the cooler being accessible by transitioning the second handle panel and second top panel to an open position while the first handle panel and the first top panel are in the partially closed, carry configuration of the cooler.

In another aspect, a one-piece, foldable cooler comprises: (a) a storage portion, including: (i) a bottom panel comprising first and second bottom subpanels (210,211), (ii) two side panels (212,214), (iii) a first end panel comprising first and second end subpanels (216,217), and (iv) a second end panel comprising first and second end subpanels (218,219); (b) four corner panels comprising, (i) a first corner panel comprising first and second corner panels (220,221), (ii) a second corner panel comprising first and second corner panels (222,223), (iii) a third corner panel comprising first and second corner panels (224,225), and (iv) a fourth corner panel comprising first and second corner panels (226,227); (c) two top panels for forming a cooler lid comprising, (i) a first top panel (228), and (ii) a second top panel (230); (d) a first handle panel (232) having first and second slots (231,233) formed therein; (e) a second handle panel (236) having first and second slots (239,241) formed therein; (f) a first tab panel comprising, (i) a first tab subpanel (242), and (ii) a second tab subpanel (244), with a fold line extending between and dividing the first and second tab subpanels along which the first and second tab subpanels when folded form a first two-ply tab from "L" shaped protuberances (243,245), (iii) wherein the first tab panel is integral with the first corner panel and the first top panel, with a fold line extending between and dividing the first tab panel and the first corner panel, and with a fold line extending between and dividing the first tab panel and the first top panel, (iv) wherein the first two-ply tab is configured to extend through the slot (231) of the first handle panel for locking the first handle panel and first top panel in a partially closed, carry configuration of the cooler, and (v) wherein the first two-ply tab is configured to extend further through slot (239) of the second handle panel for locking the second handle panel and second top panel in a fully closed, carry configuration of the cooler; and (g) a second tab panel comprising, (i) a first tab subpanel (246), and (ii) a second tab subpanel (248), with a fold line extending between and dividing the first and second tab subpanels along which the first and second tab subpanels when folded form a second two-ply tab from "L" shaped protuberances (247,249), (iii) wherein the second tab panel is integral with the second corner panel and the first top panel, with a fold line extending between and dividing the second tab panel and the second corner panel, and with a fold line extending between and dividing the second tab panel and the first top panel, (iv) wherein the second two-ply tab is configured to extend through slot (233) of the first handle panel for locking the first handle panel and first top panel in the partially closed, carry configuration of the cooler, and (v) wherein the second two-ply tab is configured to extend further through slot (241) of the second handle panel for locking the second handle panel and second top panel in the fully closed, carry configuration of the cooler, with an interior of the cooler being accessible by transitioning the second handle panel and second top panel to an open position while the first handle panel and the first top panel are in the partially closed, carry configuration of the cooler.

In a feature, the cooler further comprises a hinge panel (290) connecting the second top panel to the second side panel.

In a feature, each tab is locked with the first handle panel by manipulating a portion of the first handle panel within a recess defined by and between each respective tab and the tab subpanels thereof. Preferably, the second handle panel is locked onto the tabs by receiving a portion of the second handle panel within the recess defined by and between each respective tab and the tab subpanels thereof.

In a feature, each of the slots (231,233) is configured for a tab to be inserted and withdrawn therethrough adjacent a proximal side portion of the slot, and is configured for a tab not to be inserted and withdrawn therethrough adjacent a distal side portion of the slot, whereby outward positioning of a tab when inserted through a slot locks the tab within the slot against being withdrawn from the slot. Preferably, the slots (239,241) formed in the second handle panel overlap a portion of the slots formed in the first handle panel that includes the distal side portions thereof but that does not include the proximal side portions thereof, whereby the second handle panel locks the tabs in their outward disposition and keeps the tabs from being moved to adjacent the proximal side portions of the slots formed in the first handle portion when the second handle panel is locked.

In a feature, the cooler is a flat configuration.

In a feature, the cooler is an unassembled configuration in the form of a blank.

In a feature, the cooler is an assembled configuration.

In a feature, the cooler comprises a fold line that bisects the cooler and the cooler is in a flat configuration, folded along said bisecting fold line.

In another aspect, a one-piece blank for making a foldable corrugated cooler comprises a plurality of fold lines defining panels therein comprising: (a) a storage portion, including: (i) a bottom panel comprising first and second bottom subpanels (210,211), (ii) two side panels (212,214), (iii) a first end panel comprising first and second end subpanels (216,217), (iv) a second end panel comprising first and second end subpanels (218,219); (b) four corner panels comprising, (i) a first corner panel comprising first and second corner panels (220,221), (ii) a second corner panel comprising first and second corner panels (222,223), (iii) a third corner panel comprising first and second corner panels (224,225), and (iv) a fourth corner panel comprising first and second corner panels (226,227); (c) two top panels for forming a cooler lid comprising, (i) a first top panel (228), and (ii) a second top panel (230); (d) a first handle panel (232) having first and second slots (231,233) formed therein; (e) a second handle panel (236) having first and second slots (239,241) formed therein; (f) a first tab panel comprising, (i) a first tab subpanel (242), and (ii) a second tab subpanel (244), with a fold line extending between and dividing the first and second tab subpanels along which the first and second tab subpanels when folded form a first two-ply tab from "L" shaped protuberances (243,245), (iii) wherein the first tab panel is integral with the first corner panel and the first top panel, with a fold line extending between and dividing the first tab panel and the first corner panel, and with a fold line extending between and dividing the first tab panel and the first top panel, (iv) wherein the first two-ply tab is configured to extend through the slot (231) of the first handle panel for locking the first handle panel and first top panel in a partially closed, carry configuration of the cooler, and (v) wherein the first two-ply tab is configured to extend further through slot (239) of the second handle panel for locking the second handle panel and second top panel in a fully closed, carry configuration of the cooler; and (g) a second tab panel comprising, (i) a first tab subpanel (246), and (ii) a second tab subpanel (248), with a fold line extending between and dividing the first and second tab subpanels along which the first and second tab subpanels when folded form a second two-ply tab from "L" shaped protuberances (247,249), (iii) wherein the second tab panel is integral with the second corner panel and the first top panel, with a fold line extending between and dividing the second tab panel and the second corner panel, and with a fold line extending between and dividing the second tab panel and the first top panel, (iv) wherein the second two-ply tab is configured to extend through slot (233) of the first handle panel for locking the first handle panel and first top panel in the partially closed, carry configuration of the cooler, and (v) wherein the second two-ply tab is configured to extend further through slot (241) of the second handle panel for locking the second handle panel and second top panel in the fully closed, carry configuration of the cooler, with an interior of the cooler being accessible by transitioning the second handle panel and second top panel to an open position while the first handle panel and the first top panel are in the partially closed, carry configuration of the cooler.

In another aspect, a cooler comprise: a storage portion; corner panels; top panels forming a cooler lid; a first handle panel connected to a first of the top panels and having a slot formed therein; a second handle panel connected to a second of the top panels and having a slot formed therein; and a first tab panel comprising a tab defining a recess, the tab being configured to extend through the slot of the first handle panel for locking the first handle panel and first top panel connected thereto in a partially closed, carry configuration of the cooler, and being configured to extend further through the slot of the second handle panel for locking the second handle panel and the second top panel in a fully closed, carry configuration of the cooler.

In a feature, the cooler further comprises a second tab panel comprising a second tab defining a second recess, the second tab being configured to extend through another slot of the first handle panel for locking the first handle panel and first top panel connected thereto in the partially closed, carry configuration of the cooler, and being configured to extend further through another slot of the second handle panel for locking the second handle panel and the second top panel in a fully closed, carry configuration of the cooler.

In another feature, the tab is locked with the first handle panel by manipulating a portion of the first handle panel within the recess defined by the tab. Preferably, the second handle panel is locked onto the tab by receiving a portion of the second handle panel within the recess defined by the tab.

In a feature, the slot of the first handle panel is configured for the tab to be inserted and withdrawn therethrough adjacent a proximal side portion of the slot, and is configured for a tab not to be inserted and withdrawn therethrough adjacent a distal side portion of the slot, whereby outward positioning of the tab when inserted through the slot locks the tab within the slot against being withdrawn from the slot. Preferably, the slot formed in the second handle panel overlaps a portion of the slot formed in the first handle panel that includes the distal side portion thereof but that does not include the proximal side portion thereof, whereby the second handle panel locks the tab in the outward disposition and keeps the tab from being moved to adjacent the proximal side portion of the slot formed in the first handle portion when the second handle panel is locked on the tab.

In another aspect, a one-piece blank for making a foldable corrugated cooler comprises a plurality of fold lines defining panels therein comprising: panels that, when folded, define a storage portion of the cooler; corner panels; top panels for forming a cooler lid; a first handle panel connected to a first of the top panels and having a slot formed therein; a second handle panel connected to a second of the top panels and having a slot formed therein; and a first tab panel comprising a tab defining a recess, the tab being configured to extend through the slot of the first handle panel for locking the first handle panel and first top panel connected thereto in a partially closed, carry configuration of the cooler, and being configured to extend further through the slot of the second handle panel for locking the second handle panel and the second top panel in a fully closed, carry configuration of the cooler.

Additional aspects and features are found in that which is incorporated herein by reference.

In addition to the aforementioned aspects and features of the present invention, it should be noted that the present invention further encompasses the various logical combinations and subcombinations of such aspects and features. Thus, for example, claims in this or a divisional or continuing patent application or applications may be separately directed to any aspect, feature, or embodiment disclosed herein, or combination thereof, without requiring any other aspect, feature, or embodiment.

BRIEF DESCRIPTION OF THE DRAWINGS

Preferred embodiments of the present invention now will be described in detail with reference to the accompanying drawings.

DETAILED DESCRIPTION

Figure 1:
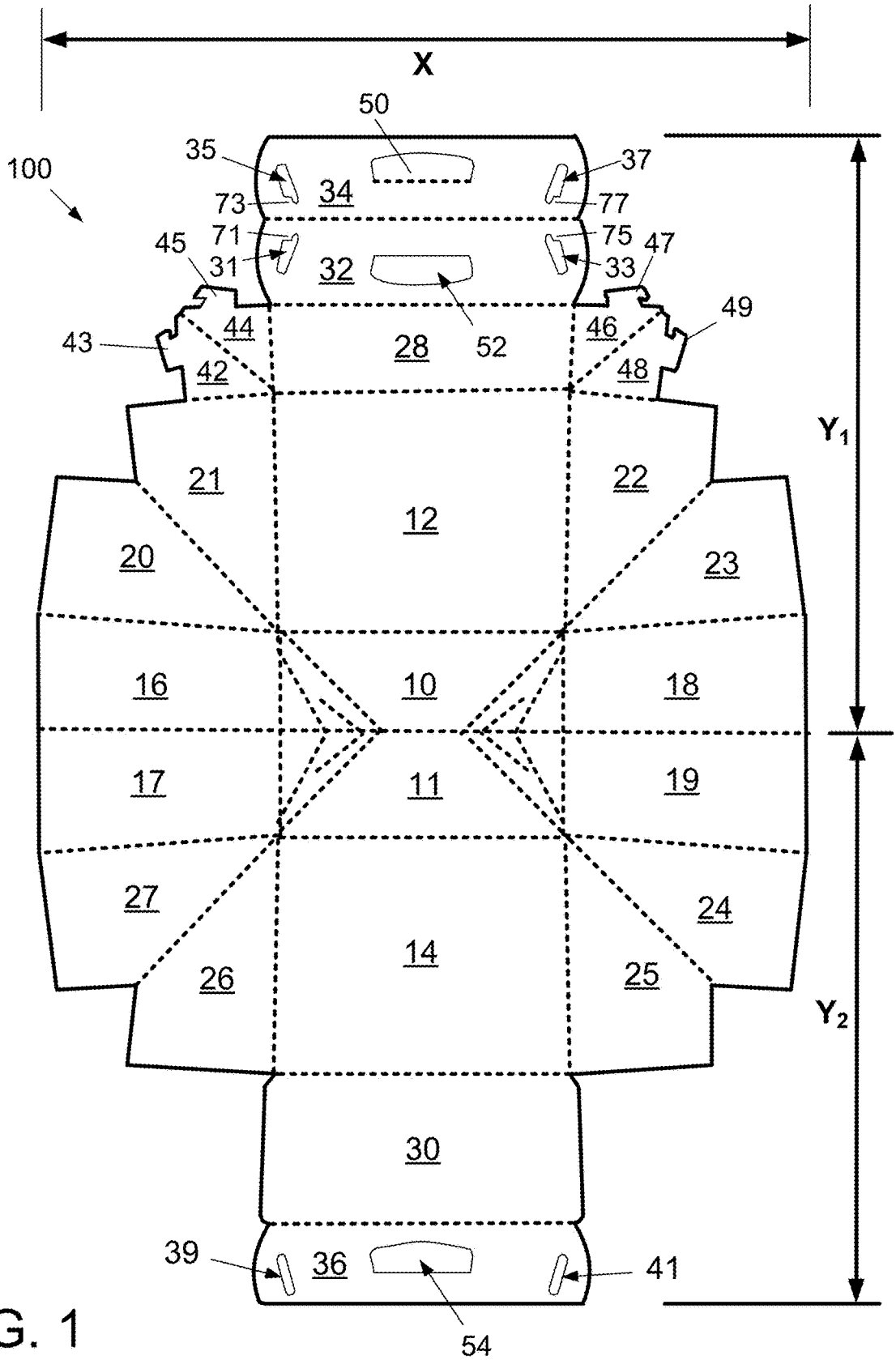
FIG. 1 is a schematic illustration of a top plan view of a blank in accordance with preferred embodiments of the invention.

As a preliminary matter, it will readily be understood by one having ordinary skill in the relevant art ("Ordinary Artisan") that the invention has broad utility and application. Furthermore, any embodiment discussed and identified as being "preferred" is considered to be part of a best mode contemplated for carrying out the invention. Other embodiments also may be discussed for additional illustrative purposes in providing a full and enabling disclosure of the invention. Furthermore, an embodiment of the invention may incorporate only one or a plurality of the aspects of the invention disclosed herein; only one or a plurality of the features disclosed herein; or combination thereof. As such, many embodiments are implicitly disclosed herein and fall within the scope of what is regarded as the invention.

Accordingly, while the invention is described herein in detail in relation to one or more embodiments, it is to be understood that this disclosure is illustrative and exemplary of the invention and is made merely for the purposes of providing a full and enabling disclosure of the invention. The detailed disclosure herein of one or more embodiments is not intended, nor is to be construed, to limit the scope of patent protection afforded the invention in any claim of a patent issuing here from, which scope is to be defined by the claims and the equivalents thereof. It is not intended that the scope of patent protection afforded the invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once during performance of the claimed method.

Furthermore, it is important to note that, as used herein, "comprising" is open-ended insofar as that which follows such term is not exclusive. Additionally, "a" and "an" each generally denotes "at least one" but does not exclude a plurality unless the contextual use dictates otherwise. Thus, reference to "a picnic basket having an apple" is the same as "a picnic basket comprising an apple" and "a picnic basket including an apple", each of which identically describes "a picnic basket having at least one apple" as well as "a picnic basket having apples"; the picnic basket further may contain one or more other items beside an apple. In contrast, reference to "a picnic basket having a single apple" describes "a picnic basket having only one apple"; the picnic basket further may contain one or more other items beside an apple. In contrast, "a picnic basket consisting of an apple" has only a single item contained therein, i.e., one apple; the picnic basket contains no other item.

When used herein to join a list of items, "or" denotes "at least one of the items" but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers"; the picnic basket further may contain one or more other items beside cheese and crackers.

When used herein to join a list of items, "and" denotes "all of the items of the list". Thus, reference to "a picnic basket having cheese and crackers" describes "a picnic basket having cheese, wherein the picnic basket further has crackers", as well as describes "a picnic basket having crackers, wherein the picnic basket further has cheese"; the picnic basket further may contain one or more other items beside cheese and crackers.

The phrase "at least one" followed by a list of items joined by "and" denotes an item of the list but does not require every item of the list. Thus, "at least one of an apple and an orange" encompasses the following mutually exclusive scenarios: there is an apple but no orange; there is an orange but no apple; and there is both an apple and an orange. In these scenarios if there is an apple, there may be more than one apple, and if there is an orange, there may be more than one orange. Moreover, the phrase "one or more" followed by a list of items joined by "and" is the equivalent of "at least one" followed by the list of items joined by "and".

Referring now to the drawings, one or more preferred embodiments of the invention are next described. The following description of one or more preferred embodiments is merely exemplary in nature and is in no way intended to limit the invention, its implementations, or uses.

Preferred Embodiments

A blank 100 for forming preferred embodiments of the one-piece, foldable cooler of the present invention is shown in FIG. 1. The blank comprises a single sheet of material; in preferred embodiments, the material is corrugated cardboard. The blank may include printing on the surface of the sheet material. Preferred dimensions of the blank 100 include a width X of 30.375 inches and a length consisting of a first sublength $Y_1$ of 24.0625 and a second sublength $Y_2$ of 23 inches.

Fold lines define panels of the blank. In the drawings, dashed lines represent the fold lines. The fold lines preferably comprise lines of weakness formed in the sheet material of the blank. The lines of weakness may comprise score lines formed in the material when the blank is made.

The blank 100 is folded along the fold lines with corner panels being adhered or otherwise affixed to side and end panels whereby preferred embodiments of the one-piece, foldable cooler in an assembled configuration are made. In particular, a first corner panel is adhered or otherwise affixed to a first end panel, a second corner panel is adhered or otherwise affixed to a second end panel, and third and fourth corner panels are adhered or otherwise affixed to a side panel when the cooler is in the assembled configuration.

Accordingly, the panels consist of an integral piece of corrugated cardboard, and the preferred embodiments of the cooler are made by folding the single sheet of corrugated cardboard, with the panels forming different portions of the preferred embodiment of the cooler. The preferred embodiments of the cooler—in the form of the blank—thereby are transitioned from a flat configuration to an assembled configuration for use by folding the blank along the fold lines.

Additionally, a fold line bisects the end panels and bottom panel such that preferred embodiments of the cooler, when in the assembled configuration, are foldable into a collapsed configuration for storage, shipping, disposal or recycling after use, and/or retail sale.

It will be appreciated that the panels are described herein with reference to portions of the cooler that are made by the panels when the blank is folded. In this regard, the one-piece, foldable cooler generally comprises, inter alia, a storage area, corners, lid, handle, and locking tabs.

Bottom, Side, and End Panels Forming Storage Area

The storage area comprises a bottom panel comprising first and second bottom subpanels 10,11; two side panels 12,14; a first end panel comprising first and second end subpanels 16,17; and a second end panel comprising first and second end subpanels 18,19. When the blank is folded into the use configuration of the cooler, the bottom, side, and end panels form the storage area of the cooler within which ice, beverages, and food can be received and retained.

Corner Panels

The four corner panels comprise a first corner panel comprising first and second corner subpanels 20,21; a second corner panel comprising first and second corner subpanels 22,23; a third corner panel comprising first and second corner subpanels 24,25; and a fourth corner panel comprising first and second corner subpanels 26,27. When the blank is folded into the use configuration of the cooler, each corner panel forms a corner of the cooler that bridges an end panel and a side panel.

Top Panels

Two top panels form the cooler lid, including a first top panel 28 and a second top panel 30. When the blank is folded into the use configuration of the cooler, the top panels cover the mouth of the storage area, enclosing any ice, beverage, and food that has been received within the storage area.

Handle Panels

The handle comprises a first handle panel and a second handle panel. The first handle panel comprises a first handle subpanel 32 and a second handle subpanel 34. The first handle subpanel 32 comprises first and second slots 31,33 formed therein. The second handle subpanel 34 comprises first and second slots 35,37 formed therein, with a fold line extending between and dividing the first and second handle subpanels 32,34 along which the first and second handle subpanels 32,34, when folded, form a two-ply handle of the cooler. The second handle panel 36 comprises first and second slots 39,41 formed therein. When the blank is folded into the use configuration of the cooler, the handle panels form handles for carrying the cooler and for effecting manual opening and closing of the cooler.

A grip is formed by a cutout in the second handle subpanel 34 so as to define a hinged flap 50, and a corresponding opening 52 is formed in the first handle subpanel 32 and another corresponding opening 54 is formed in the handle panel 54. The flap 50 is extendable through the opening 52 and then the opening 54.

First Tab Panel

The cooler further comprises a first tab panel. The first tab panel comprises a first tab subpanel 42; and a second tab subpanel 44, with a fold line extending between and dividing the first and second tab subpanels 42,44 along which the first and second tab subpanels 42,44, when folded, form a first two-ply tab from two "L" shaped protuberances 43,45. The protuberances 43,45 when folded together define with the subpanels 42,44 a first recess.

Additionally, the first tab panel—and specifically subpanel 42—is integral with the first corner panel—and specifically subpanel 21, with a fold line extending between and dividing the first tab panel and the first corner panel; and the first tab panel—and specifically subpanel 44—is integral with the first top panel 28, with a fold line extending between and dividing the first tab panel and the first top panel.

When the blank is folded into the use configuration, the first two-ply tab formed by the protuberances 43,45 is configured to extend through slot 31 and then slot 35 of the first handle panel for locking the first handle panel and first top panel in a partially closed, carry configuration of the cooler. The first two-ply tab is extended through the slots 31,35 by first inserting the first two-ply tab through the slots 31,35 adjacent respective proximate side portions of the slots 31,35. The first two-ply tab then is pushed outwardly so as to be located adjacent respective distal side portions of the slots 31,35. In pushing the first two-ply tab outwardly, respective portions 71,73 of the handle subpanels 32,34 are received within the first recess defined by the protuberances 43,45 and the subpanels 42,44, whereby the first two-ply tab is locked from being withdrawn from the slots 32,34. To withdraw the first two-ply tab and unlock the first handle panel and first top panel from the corner panels, the first two-ply tab is pushed inwardly such that these portions 71,73 of the handle subpanels 32,34 clear the first recess. The first two-ply tab additionally is configured to extend further through slot 39 with the second handle panel 36 being received within the first recess, too, for additional locking of the second handle panel 36 and second top 30 panel by the first two-ply tab in a fully closed, carry configuration of the cooler.

Second Tab Panel

The cooler further comprises a second tab panel. The second tab panel comprises a first tab subpanel 46; and a second tab subpanel 48, with a fold line extending between and dividing the first and second tab subpanels 46,48 along which the first and second tab subpanels 46,48, when folded, form a second two-ply tab from two "L" shaped protuberances 47,49. The protuberances 46,48 when folded together define with the subpanels 46,48 a second recess.

Additionally, as with the first tab panel, the second tab panel—and specifically subpanel 48—is integral with the second corner panel—and specifically subpanel 22, with a fold line extending between and dividing the second tab panel and the second corner panel; and the second tab panel—and specifically subpanel 46—is integral with the first top panel 28, with a fold line extending between and dividing the second tab panel and the first top panel.

When the blank is folded into the use configuration, the second two-ply tab formed by the protuberances 47,49 is configured to extend through slot 33 and then slot 37 of the first handle panel for locking the first handle panel and first top panel in the partially closed, carry configuration of the cooler. The second two-ply tab is extended through the slots 33,37 by first inserting the second two-ply tab through the slots 33,37 adjacent respective proximal side portions of the slots 33,37. The second two-ply tab then is pushed outwardly so as to be located adjacent respective distal side portions of the slots 33,37. In pushing the second two-ply tab outwardly, respective portions 75,77 of the handle subpanels 32,34 are received within the second recess defined by the protuberances 47,49 and the subpanels 46,48, whereby the second two-ply tab is locked from being withdrawn from the slots 33,37. To withdraw the second two-ply tab and unlock the first handle panel and first top panel from the corner panels, the second two-ply tab is pushed inwardly such that these portions 75,77 of the handle subpanels 32,34 clear the second recess. The second two-ply tab additionally is configured to extend further through slot 41 with the second handle panel 36 being received within the second recess, too, for additional locking of the second handle panel 36 and second top 30 panel by the second two-ply tab in the fully closed, carry configuration of the cooler.

Figure 2:
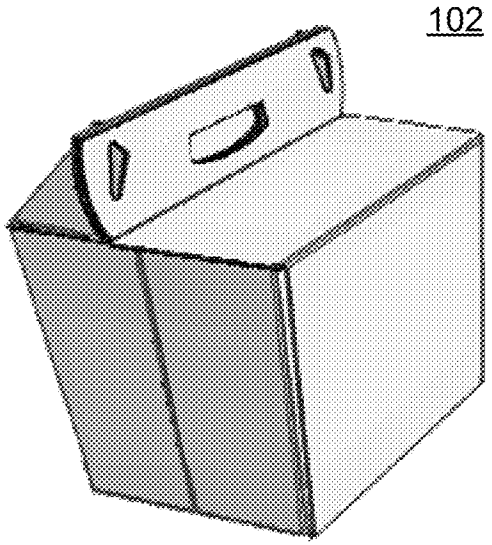
FIG. 2 is a perspective view of an embodiment of a cooler formed by folding the blank of FIG. 1.
Figure 3:
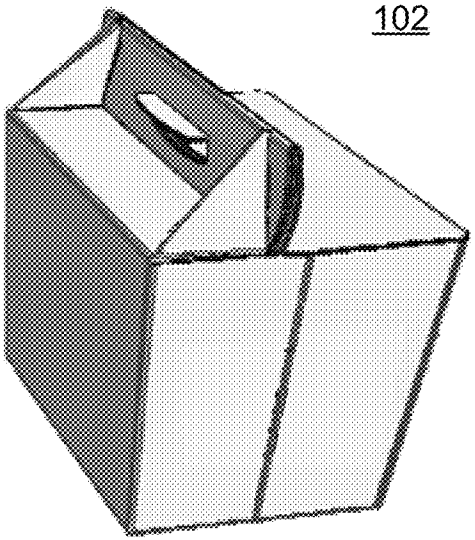
FIG. 3 is another perspective view of the embodiment of a cooler of FIG. 2 when viewed from the opposite end thereof
Figure 4:
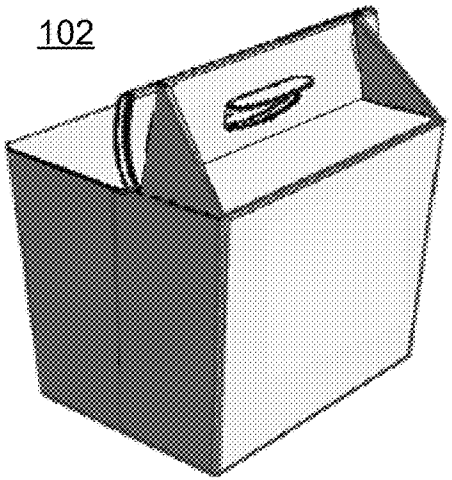
FIG. 4 is another perspective view of the embodiment of the cooler of FIG. 2.

Additionally, the first and second two-ply tabs preferably are used together for locking the first and second handle panels and the first and second top panels in the fully closed, carry configuration of the cooler. Such configuration in which both the first and second handle panels are locked is seen in each of FIGS. 2-4, wherein the assembled configuration of the cooler 102 is seen.

Slot Opening Overlap

Each slot formed in the second handle panel preferably overlaps only a portion of the slot formed in the first handle panel when the handle panels are locked by the tabs. The overlapping portion includes the distal side portion of the slot of the first handle panel, but does not include the proximal side portion of the slot of the first handle panel, whereby the second handle panel locks the tab in the outward disposition and inhibits or blocks the tab from being moved to adjacent the proximal side portion of the slot formed in the first handle portion when the second handle panel is locked on the tab. This relationship in the overlapping of the slots of the different handle panels is perhaps best seen by comparison of FIGS. 27 and 28. Furthermore, due to the folding of the tab panels over the first top panel when locking the handle panels, the tab panels to be biased upwardly and, thus, tend to be biased toward the distal side portions of the slots when the cooler is in both the partially closed, carry configuration and in the fully closed, carry configuration.

Convenient Access to the Storage Area

It will be appreciated that in the partially closed, carry configuration of the cooler when the first handle panel and first top panel is locked, and the second handle panel and the second top panel are unlocked, i.e., no tab extends through either slot 39 or slot 41, the storage area of the cooler is accessible while the cooler is being held by the first handle panel that is locked together with the first top panel 28 to the corner subpanels 21,22. The cooler is thereby transitioned from the fully closed, carry configuration of the cooler to the partially closed, carry configuration of the cooler in which the second handle panel 36 and the second top panel 30 are unlocked and moved from the corner subpanels 21,22. In the partially closed, carry configuration of the cooler, a person may hold the cooler with one hand and access the storage area with the other hand for retrieving one or more items received and retained therein.

Method of Closing and Locking the Cooler

Figure 5:
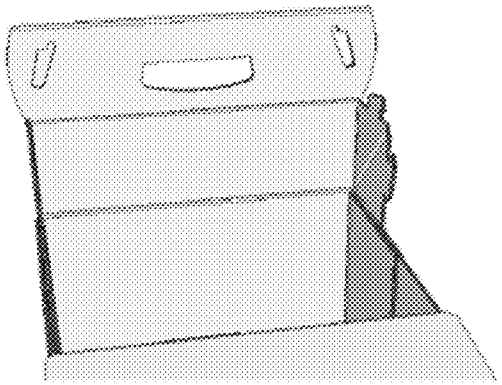
FIG. 5 is a perspective view of a top portion of the embodiment of the cooler of FIG. 1 with the storage area of the cooler completely accessible.
Figure 6:
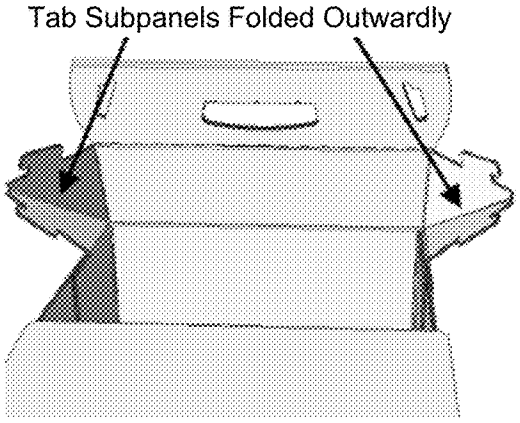
FIG. 6 is another perspective view of the top portion of the embodiment of the cooler of FIG. 5, wherein tab subpanels are being folded outwardly.
Figure 7:
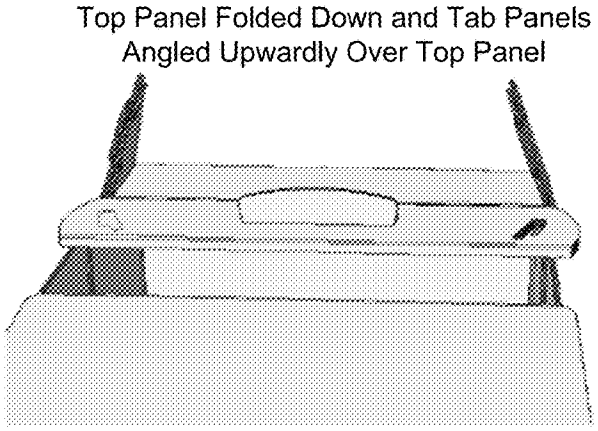
FIG. 7 is another perspective view of the top portion of the embodiment of the cooler of FIG. 5, wherein the top panel has been folded down over the storage area and the tab panels are inclined over the top panel.
Figure 8:
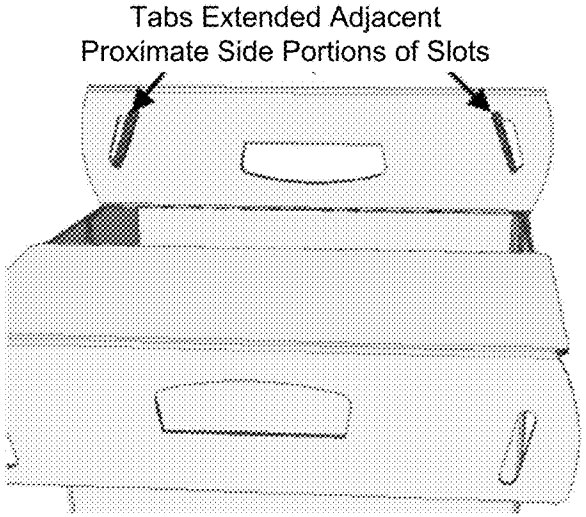
FIG. 8 is another perspective view of the top portion of the embodiment of the cooler of FIG. 5, wherein tabs have been inserted through slots in the handle panel.
Figure 9:
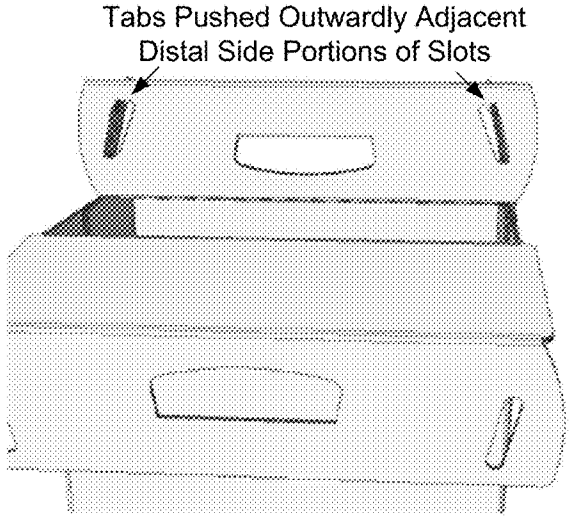
FIG. 9 is another perspective view of the top portion of the embodiment of the cooler of FIG. 5, wherein the tabs have been pushed outwardly locking the handle panel to the tabs.
Figure 10:
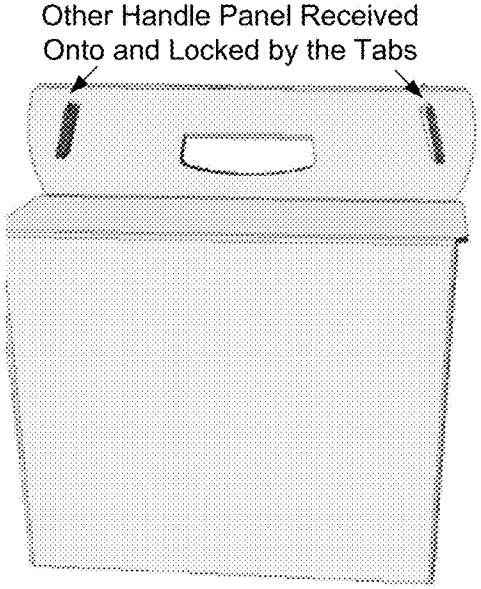
FIG. 10 is another perspective view of the top portion of the embodiment of the cooler of FIG. 5, wherein the other handle panel has been locked onto the tabs with the cooler in the fully closed, carry configuration.

A preferred method of closing the cooler is illustrated in FIGS. 5-10. The cooler is seen in FIG. 5 prior to folding of the locking tab subpanels, handle panel, and top panel. The method begins in FIG. 6 with the folding of the tab subpanels to form the tab panels. The folding of the tab subpanels is done outwardly such that the tab panels extend exterior of the cooler on opposite ends thereof. The top panel then is folded into covering relation to the storage area of the cooler, with the tab panels inclined over the top panel, as seen in FIG. 7. The handle panel then is folded upwardly and back toward the tabs of the tab panels such that the tabs are received through the slots in the handle panel. This is done by the tabs being extended through the slots adjacent proximate side portions of the slots, as seen in FIG. 8, and then pushing the tabs outwardly to be located adjacent distal side portions of the slots, as seen in FIG. 9. The other handle panel this is folded back and received onto and locked by the tabs, with the tabs extending through the slots of the other handle panel and a portion of the other handle panel being inserted down into the recesses defined between the tabs and the tab subpanels. Both handles are thereby locked with the cooler in the fully closed, carry configuration as seen in FIG. 10.

Additional Preferred Embodiments

Figure 11:
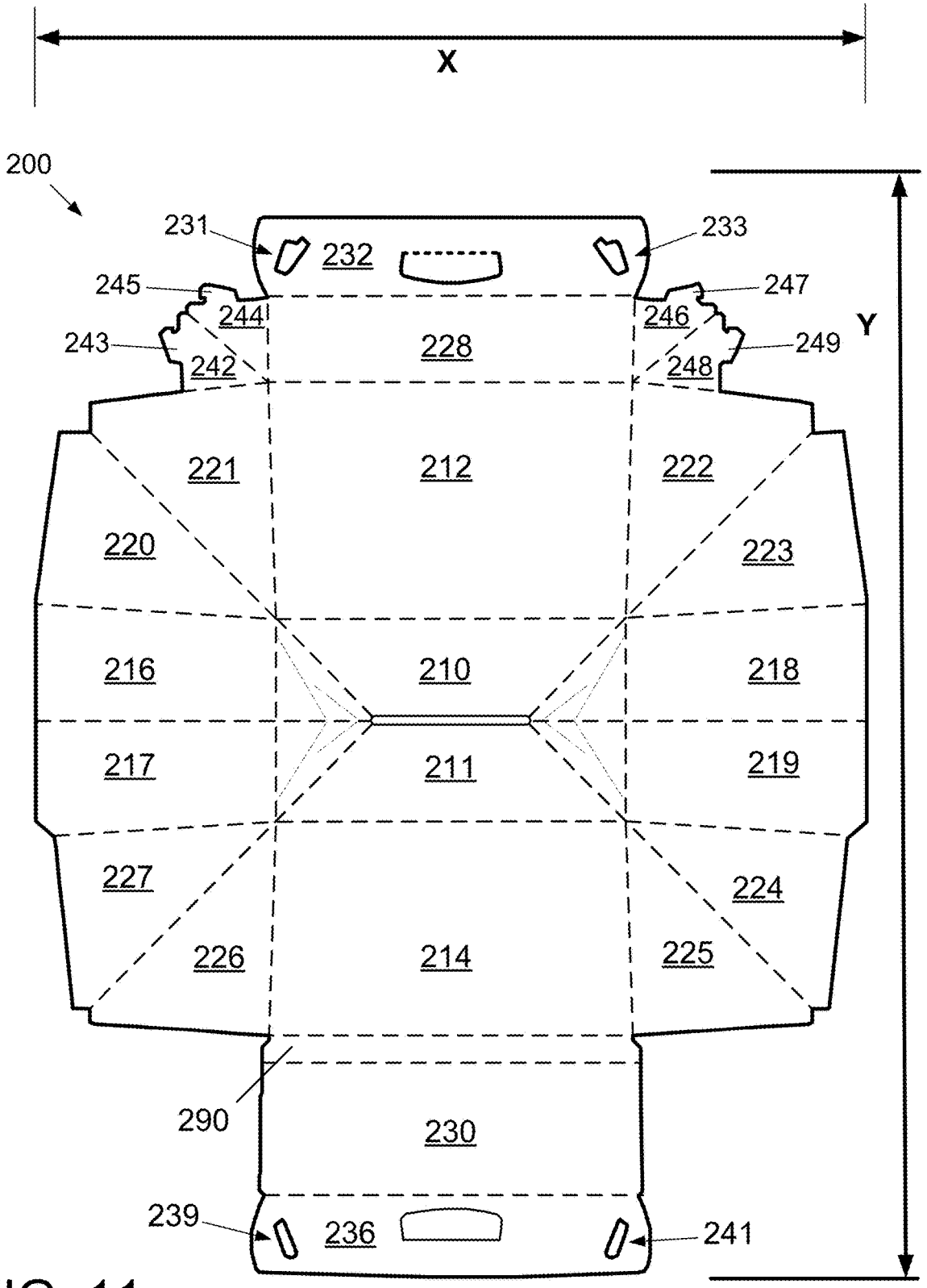
FIG. 11 is a schematic illustration of a top plan view of another blank in accordance with preferred embodiments of the invention.

Another blank 200 for forming additional preferred embodiments of the one-piece, foldable cooler of the present invention is shown in FIG. 11. The blank 200 is similar to blank 100 and comprises a single sheet of material; in preferred embodiments, the material is corrugated cardboard. The blank may include printing on the surface of the sheet material. Preferred dimensions of the blank 200 include a width X of 33 inches and an overall length Y of 43.3125 inches.

Like the blank 100, the one-piece, foldable cooler represented by blank 200 comprises: a storage portion, including a bottom panel comprising first and second bottom subpanels 210,211; two side panels 212,214; a first end panel comprising first and second end subpanels 216,217; and a second end panel comprising first and second end subpanels 218,219. The blank 200 further comprises four corner panels comprising: a first corner panel comprising first and second corner panels 220,221; a second corner panel comprising first and second corner panels 222,223; a third corner panel comprising first and second corner panels 224,225; and a fourth corner panel comprising first and second corner panels 226,227. The blank also comprises two top panels for forming a cooler lid, comprising a first top panel 228 a second top panel 230. Unlike blank 100, the blank 200 has a first handle panel 232 with first and second slots 231,233 formed therein, which first handle panel is single-ply and does not include two subpanels. The blank 200 does include a single-ply second handle panel 236 with first and second slots 239,241 formed therein, like blank 100.

Blank 200 also includes a first tab panel comprising a first tab subpanel 242 and a second tab subpanel 244, with a fold line extending between and dividing the first and second tab subpanels along which the first and second tab subpanels when folded form a first two-ply tab from "L" shaped protuberances 243,245. The first tab panel is integral with the first corner panel and the first top panel, with a fold line extending between and dividing the first tab panel and the first corner panel, and with a fold line extending between and dividing the first tab panel and the first top panel; and the first two-ply tab is configured to extend through the slot 231 of the first handle panel for locking the first handle panel and first top panel in a partially closed, carry configuration of the cooler. The first two-ply tab is configured to extend further through slot 239 of the second handle panel for locking the second handle panel and second top panel in a fully closed, carry configuration of the cooler, similar to as described above with respect to blank 100.

Blank 200 also includes a second tab panel comprising a first tab subpanel 246, and a second tab subpanel 248, with a fold line extending between and dividing the first and second tab subpanels along which the first and second tab subpanels when folded form a second two-ply tab from "L" shaped protuberances 247,249. The second tab panel is integral with the second corner panel and the first top panel, with a fold line extending between and dividing the second tab panel and the second corner panel, and with a fold line extending between and dividing the second tab panel and the first top panel; and the second two-ply tab is configured to extend through slot 233 of the first handle panel for locking the first handle panel and first top panel in the partially closed, carry configuration of the cooler. The second two-ply tab is configured to extend further through slot 241 of the second handle panel for locking the second handle panel and second top panel in the fully closed, carry configuration of the cooler, similar to as described above with respect to blank 100. The interior storage area of the cooler is accessible by transitioning the second handle panel and second top panel to an open position while the first handle panel and the first top panel are in the partially closed, carry configuration of the cooler.

Unlike blank 100, blank 200 additionally comprises a hinge panel 290 that connects the second top panel 230—and indirectly second handle panel 236—to the second side panel 214 for easier manipulation of the second handle panel 236 when manipulating the second handle panel onto the tabs in locking disposition therewith with the second handle panel received within the recesses defined between the tabs and the tab subpanels.

Commercial Embodiments

A commercial embodiment formed using a blank of which blank 100 is representative is seen in FIGS. 12-22 of U.S. patent application publication no. US 2019/0047743 A1; and a commercial embodiment formed using a blank of which blank 200 is representative is seen in FIGS. 23-28 of U.S. patent application publication no. US 2019/0047743 A1. The disclosure of U.S. patent application publication no. US 2019/0047743 A1—which is the publication of the present application—is hereby incorporated herein by reference.

* * *

Based on the foregoing description, it will be readily understood by those persons skilled in the art that the present invention has broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof. Thus, for example, while described as "L" shaped, the protuberances may take any shape so long as a recess is defined that is configured to receive and lock the handle portions as disclosed herein.

What is claimed is:

1. A one-piece, foldable cooler, comprising:

(a) a storage portion, including:
  (i) a bottom panel comprising first and second bottom subpanels,
  (ii) two side panels,
  (iii) a first end panel comprising first and second end subpanels, and
  (iv) a second end panel comprising first and second end subpanels;

(b) four corner panels comprising,
  (i) a first corner panel comprising first and second corner panels,
  (ii) a second corner panel comprising first and second corner panels,
  (iii) a third corner panel comprising first and second corner panels, and
  (iv) a fourth corner panel comprising first and second corner panels;

(c) two top panels for forming a cooler lid comprising,
  (i) a first top panel, and
  (ii) a second top panel;

(d) a first handle panel having first and second slots formed therein;

(e) a second handle panel having first and second slots formed therein;

(f) a first tab panel comprising,
  (i) a first tab subpanel, and
  (ii) a second tab subpanel, with a fold line extending between and dividing the first and second tab subpanels along which the first and second tab subpanels when folded form a first two-ply tab from "L" shaped protuberances,
  (iii) wherein the first tab panel is integral with the first corner panel and the first top panel, with a fold line extending between and dividing the first tab panel and the first corner panel, and with a fold line extending between and dividing the first tab panel and the first top panel,
  (iv) wherein the first two-ply tab is configured to extend through the slot of the first handle panel for locking the first handle panel and first top panel in a partially closed, carry configuration of the cooler, and
  (v) wherein the first two-ply tab is configured to extend further through slot of the second handle panel for locking the second handle panel and second top panel in a fully closed, carry configuration of the cooler; and (g) a second tab panel comprising,
  (i) a first tab subpanel, and
  (ii) a second tab subpanel, with a fold line extending between and dividing the first and second tab subpanels along which the first and second tab subpanels when folded form a second two-ply tab from "L" shaped protuberances,
  (iii) wherein the second tab panel is integral with the second corner panel and the first top panel, with a fold line extending between and dividing the second tab panel and the second corner panel, and with a fold line extending between and dividing the second tab panel and the first top panel, (iv) wherein the second two-ply tab is configured to extend through slot of the first handle panel for locking the first handle panel and first top panel in the partially closed, carry configuration of the cooler, and (v) wherein the second two-ply tab is configured to extend further through slot of the second handle panel for locking the second handle panel and second top panel in the fully closed, carry configuration of the cooler, with an interior of the cooler being accessible by transitioning the second handle panel and second top panel to an open position while the first handle panel and the first top panel are in the partially closed, carry configuration of the cooler.

2. The cooler of claim 1, further comprising a hinge panel connecting the second top panel to the second side panel.

3. The cooler of claim 1, wherein each tab is locked with the first handle panel by manipulating a portion of the first handle panel within a recess defined by and between each respective tab and the tab subpanels thereof.

4. The cooler of claim 3, wherein the second handle panel is locked onto the tabs by receiving a portion of the second handle panel within the recess defined by and between each respective tab and the tab subpanels thereof.

5. The cooler of claim 4, wherein each of the slots is configured for a tab to be inserted and withdrawn therethrough adjacent a proximal side portion of the slot, and is configured for a tab not to be inserted and withdrawn therethrough adjacent a distal side portion of the slot, whereby outward positioning of a tab when inserted through a slot locks the tab within the slot against being withdrawn from the slot.

6. The cooler of claim 5, wherein the slots formed in the second handle panel overlap a portion of the slots formed in the first handle panel that includes the distal side portions thereof but that does not include the proximal side portions thereof, whereby the second handle panel locks the tabs in their outward disposition and keeps the tabs from being moved to adjacent the proximal side portions of the slots formed in the first handle portion when the second handle panel is locked.

7. The cooler of claim 1, wherein the cooler is a flat configuration.

8. The cooler of claim 1, wherein the cooler is an unassembled configuration in the form of a blank.

9. The cooler of claim 1, wherein the cooler is an assembled configuration.

10. The cooler of claim 1, wherein the cooler comprises a fold line that bisects the cooler and the cooler is in a flat configuration, folded along said bisecting fold line.

* * * * *